US007789017B2

(12) United States Patent
Rodriguez et al.

(10) Patent No.: US 7,789,017 B2
(45) Date of Patent: Sep. 7, 2010

(54) BALE BANDING MACHINE WITH OVERHEAD PRESS

(76) Inventors: Peter A. Rodriguez, 1545 Main St., Atlantic Beach, FL (US) 32233; Thomas B. Middlebrooks, 1545 Main St., Atlantic Beach, FL (US) 32233

( * ) Notice: Subject to any disclaimer, the term of this patent is extended or adjusted under 35 U.S.C. 154(b) by 241 days.

(21) Appl. No.: 12/214,606

(22) Filed: Jun. 20, 2008

(65) Prior Publication Data

US 2009/0013881 A1 Jan. 15, 2009

Related U.S. Application Data

(60) Provisional application No. 60/936,707, filed on Jun. 21, 2007.

(51) Int. Cl.
*B65B 13/02* (2006.01)
*B65B 13/20* (2006.01)

(52) U.S. Cl. ..... 100/3; 100/26; 53/528

(58) Field of Classification Search ..... 100/3, 100/8, 26, 29, 32; 53/399, 436, 528, 582, 53/589

See application file for complete search history.

(56) References Cited

U.S. PATENT DOCUMENTS 2,632,381 A * 3/1953 Buckland ..... 100/7
3,515,055 A * 6/1970 Timmerbeil et al. ..... 100/3
3,735,555 A * 5/1973 Pasic ..... 53/529
4,136,610 A 1/1979 Tyler, Jr.
6,711,994 B1 * 3/2004 Daniel et al. ..... 100/26
6,951,088 B2 10/2005 Rodriguez
2003/0159409 A1 8/2003 Oda et al.
2007/0113602 A1 5/2007 Watts

* cited by examiner

*Primary Examiner*—Jimmy T Nguyen
(74) *Attorney, Agent, or Firm*—Thomas C. Saitta

(57) ABSTRACT

A bale banding machine having an overhead press head that translates in the vertical direction relative to the band guide track and the bale being banded. The band is directed through a stationary band feeding guide assembly into a band receiving guide assembly mounted on the translating press head assembly. The stationary band feeding guide assembly defines an enclosed channel, at the end of which is provided a feed guide pivoting member that is biased in a closed position until the press heads lowers, upon which event a follower cam in the feed guide pivoting member reacts to a cam wedge on the descending press head, causing the feed guide pivoting member to pivot away from the band extending between the stationary band feeding guide assembly and the translating band receiving guide assembly. Simultaneously, the head guide pivoting member is caused to pivot upward from the band. In this manner the band is no longer retained within the small guide path previously defined by the feeding guide assembly and the receiving guide assembly, such that the translating head can be lowered several inches without shearing the band.

18 Claims, 5 Drawing Sheets

BALE BANDING MACHINE WITH OVERHEAD PRESS

This patent application claims the benefit of U.S. Provisional Patent Application Ser. No. 60/936,707, filed Jun. 21, 2007.

BACKGROUND OF THE INVENTION

This invention relates generally to the field of machines that secure bands, straps or similar members around a bale, box or the like, the machine feeding a length of band about the bale such that free end of the band overlaps the body of the band, tightening the band about the bale, sealing the band to itself and cutting the connected portion of the band.

Automated bale banding machines are well known. A typical bale banding machine comprises a means to deliver a length of band, strap or the like into an encircling guide track. A conveyor means passes through the guide track, such that bales, boxes or the like can be brought into the interior of the guide track. The band is wrapped around the bale a sufficient distance so that its free end overlaps a portion of the band still connected to the feed spool. The band is then tightened to pull it from the guide track such that it is wrapped tightly surround the bale. A press head seals, bonds or connects the free end of the band to itself at the overlapped portion of the band, using heat, steam, moisture, pressure or a combination of such to create an adhesive bond. The looped band is then cut free from the remainder of the band, the banded bale is passed from the banding area, a new length of band is fed into the guide track and a new bale is brought into the banding area. An example of such a bale banding machine is seen in U.S. Pat. No. 6,951,088, the disclosure of which is incorporated herein by reference.

A problem with known bale banding machines is that the press head sealing mechanism is positioned beneath the bale during the banding operation. While this positioning means that the height of the bale can vary somewhat without affecting the banding operation, the bottom-mounted press head often suffers fouling problems. An overhead press system able to translate over a short distance to accommodate variations in bale height would be advantageous for the fouling perspective, but such a design is not utilized due to various other problems. The main problem encountered in positioning the press head overhead is that the lowering of the press head shears the band prior to it being sealed about the bale, since the band feeding mechanism remains stationary. This loss of tension results in a band that is not tightly wrapped around the bale. It is not practical to have the entire band feeding drive system as well as the press head translate in reciprocating manner from a neutral to an operational position.

It is an object of this invention to provide a bale banding machine with a properly functioning overhead press that does not shear the band as the press head is lowered. It is a further object to provide such a machine where the press head translates while the band feeding system remains stationary.

SUMMARY OF THE INVENTION

The invention is a bale banding machine comprising a stationary band feeding guide assembly and an overhead press head that reciprocatingly translates in the vertical direction relative to the band guide track and the bale being banded. The band is directed from the stationary band feeding guide assembly into a band receiving guide assembly mounted on the translating press head assembly while the press head is in the upper or retracted position. The stationary band feeding guide assembly defines an enclosed channel, at the end of which is provided a feed guide pivoting member that is biased in a closed position until the press head is lowered, upon which event a follower cam in the feed guide pivoting member reacts to a cam wedge on the descending press head, causing the feed guide pivoting member to pivot away from the band extending between the stationary band feeding guide assembly and the translating band receiving guide assembly, thereby widening the channel. Simultaneously, a head guide pivoting member in the band receiving guide assembly is caused to pivot upward and away from the band, widening the channel in the band receiving guide assembly. In this manner the band is no longer tightly retained within the small guide path previously defined by the feeding guide assembly and the receiving guide assembly, such that the translating head can be lowered several inches without shearing the band.

DETAILED DESCRIPTION OF THE INVENTION

Figure 1:
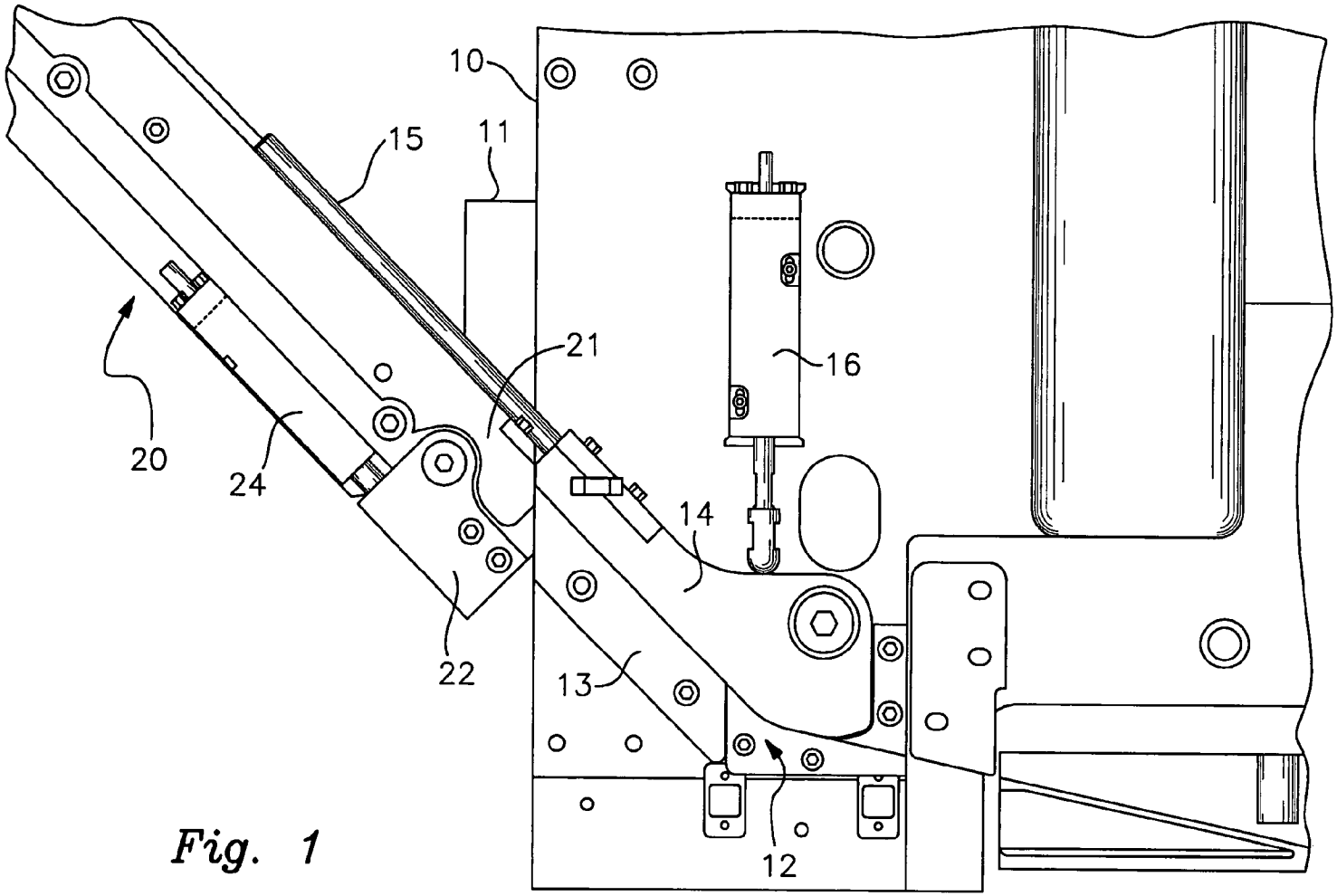
FIG. 1 is a view of the stationary feed guide assembly and the translating press head assembly, with the press head in the retracted or upper position.

With reference to the drawings, the invention is now described in detail with regard for the best mode and the preferred embodiments. In general, the invention is a bale banding machine, the term "bale banding" being used herein to encompass a machine that fastens an encircling band, strap, tape or similar member (herein referred to collectively as a "band") about a bale, box or the like (herein referred to collectively as a "bale") in order to secure the bale, box, etc. for storage, transport or the like. The bale banding machine comprises a means to deliver the band into an encircling guide track to form a loop, the guide track being generally oval, rectangular or the like to define an open interior, such that the free end of the band overlaps a portion of the band still connected to the delivery means. The bale is brought into the open interior of the guide track, such as by a conveyor, and means to tighten the band are initiated such that the band is pulled from the guide track and tightly wrapped about the bale. The band is then sealed to itself using a press head assembly and then cut free from the remainder portion. Such equipment is well known in the industry. In the invention, the bale banding machine has an overhead press head assembly, which is the component that seals the band about the bale, such that the press head is lowered onto the bale to perform the sealing operation, then retracted for the band feeding operation.

The bale banding machine comprises an overhead press head assembly 10 situated at the upper side of the guide track, the press head assembly 10 being able to translate or reciprocate in the vertical direction relative to the stationary band feeding guide assembly 20, the guide track and the bale being banded. The press head assembly 10 comprises means for bonding or sealing the tightened band 99 to itself and means for cutting the sealed band 99 from the remaining portion of the band 99. Various types of press head sealing means and cutting means are known in the art. The press head assembly 10 has a travel stroke covering multiple inches in order to account for variations in the height of the bales being banded, such that the press head assembly 10 may be extended farther for shorter bales.

A stationary band feeding guide assembly 20 is provided adjacent the translating press head assembly 10, the feeding guide assembly 20 receiving the band 99 from band delivery means. The feeding guide assembly 20 defines a generally rectangular-in-cross-section feed channel or tunnel 29 only slightly larger in dimensions than the dimensions of the band 99. The end of the feeding guide assembly 20 adjacent the translating press head 10 is comprised of a fixed cam shoulder member 21 and a feed guide pivoting member 22, which defines the last portion of the band feed channel 29. The feed guide pivoting member 22 is mounted so as to be able to pivot in response to means for pivoting said feed guide pivoting member from a closed position with the feed channel 29 generally conforming to the configuration of the band 99, to a wide or open position such that the last portion of the feed channel 29 is now very wide relative to the band 99. As shown in the embodiment of the figures, a cam follower 23 is mounted onto the feed guide pivoting member 21, the cam follower 23 moving in response to a wedge cam member 11 disposed on the translating press head assembly 10, such that as the press head assembly 10 is lowered in order to seal the band 99 about the bale, the cam follower 23 pivots the feed guide pivoting member 22 down and away from the band 99. Means for biasing said feed guide pivoting member 22, such as spring member 24, maintains the feed guide pivoting member 22 in the closed position when the translating press head assembly 10 is in the raised position.

The band 99 is received in the press head assembly 10 by a band receiving assembly 12 comprising in combination a head guide fixed member 13 and a head guide pivoting member 14, which together define the band head channel or tunnel 30 receiving the band 99 and directing it through the sealing means and the guide track. With the translating press head assembly 10 in the raised or band-feeding position, the head band receiving assembly 12 and the stationary feeding guide assembly 20 are aligned to define a generally planar pathway to receive the band 99. When the press head assembly 10 descends to the band sealing position, means for pivoting the head guide pivoting member 14 causes movement of the head guide pivoting member 14 from the closed position wherein the head channel 30 generally conforms to the configuration of the band 99 to an open position wherein the head channel 30 is very wide. As shown in the drawings, an extension member 15 extending beyond the side of the press head assembly 10 rests against the cam shoulder member 21, causing the head guide pivoting member 14 to pivot upwardly away from the band 99 and the head guide fixed member 13, widely opening the head channel 30. A means for biasing said head guide pivoting member 14, such as spring member 16, maintains the head guide pivoting member 14 in the closed position until the press head assembly 10 is lowered.

Figure 2:
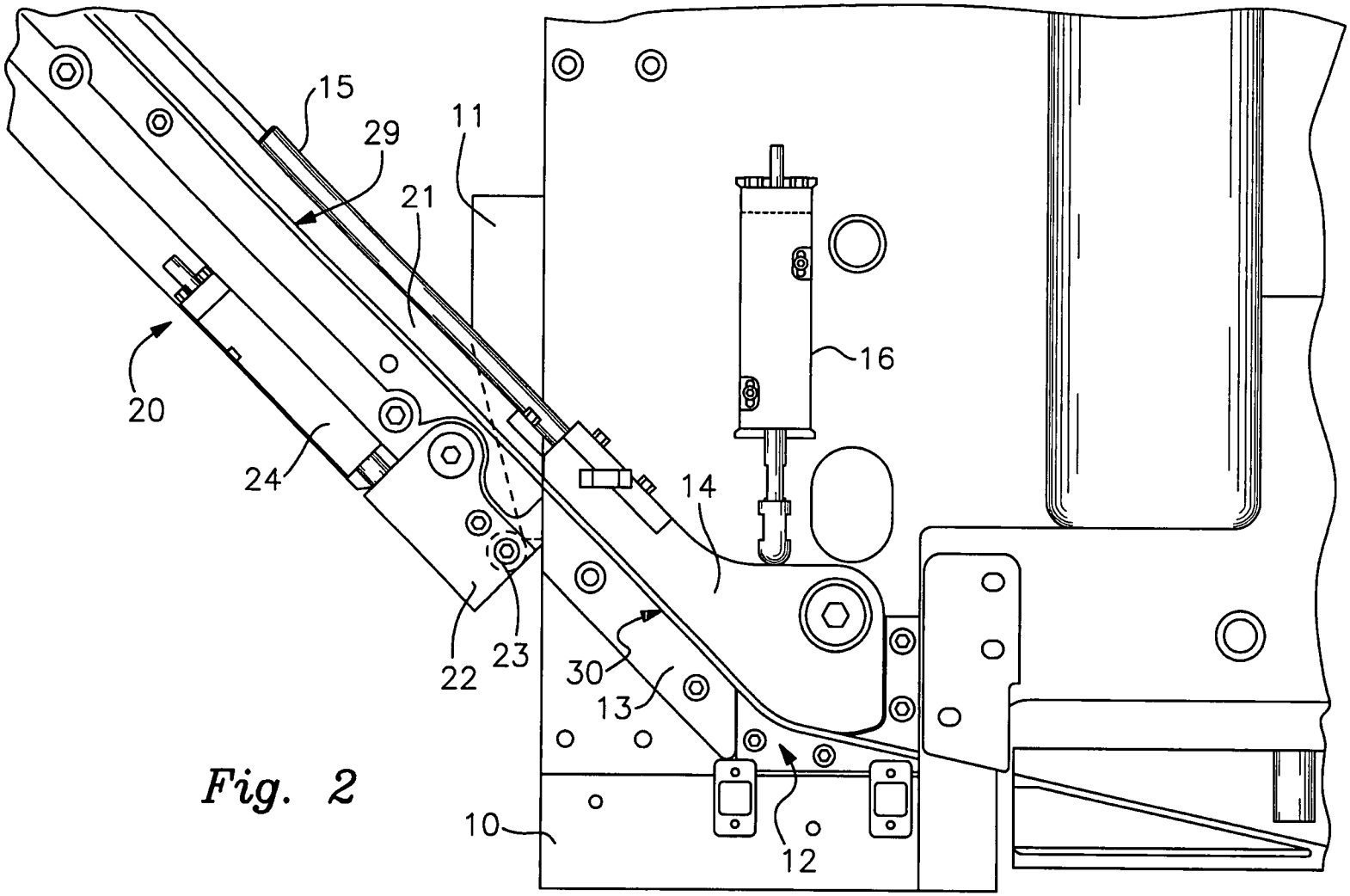
FIG. 2 is a transparent view similar to FIG. 1 of the stationary feed guide assembly and the translating press head assembly, with the press head in the retracted or upper position.

In this manner, with the press head assembly 10 in the raised or retracted position, as shown in FIGS. 1 and 2, the stationary feed guide assembly 20 and the band receiving assembly 12 are aligned such that the band 99 is delivered through the feed channel 29 in the stationary band feeding guide assembly 20, between the fixed cam shoulder member 21 and the feed guide pivoting member 22, and directly into the head channel 30 of the adjoining band receiving assembly 12 between the head guide fixed member 13 and the head guide pivoting member 14. The feed guide pivoting member 22 and the head guide pivoting member 14 are maintained in the closed position by the spring biasing means 24 and 16.

Figure 3:
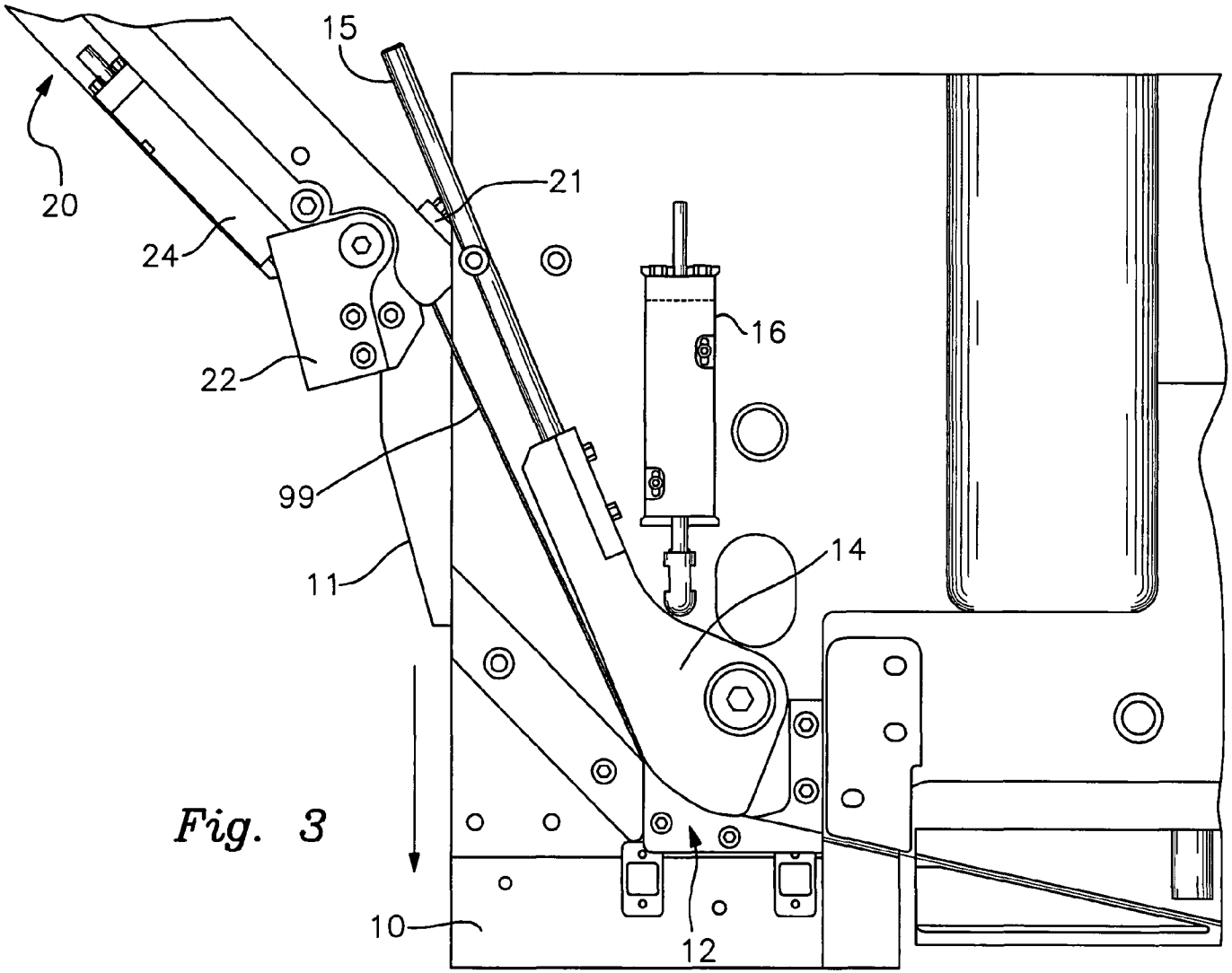
FIG. 3 is a view of the stationary feed guide assembly and the translating press head assembly, with the press head in the extended or lowered position.
Figure 4:
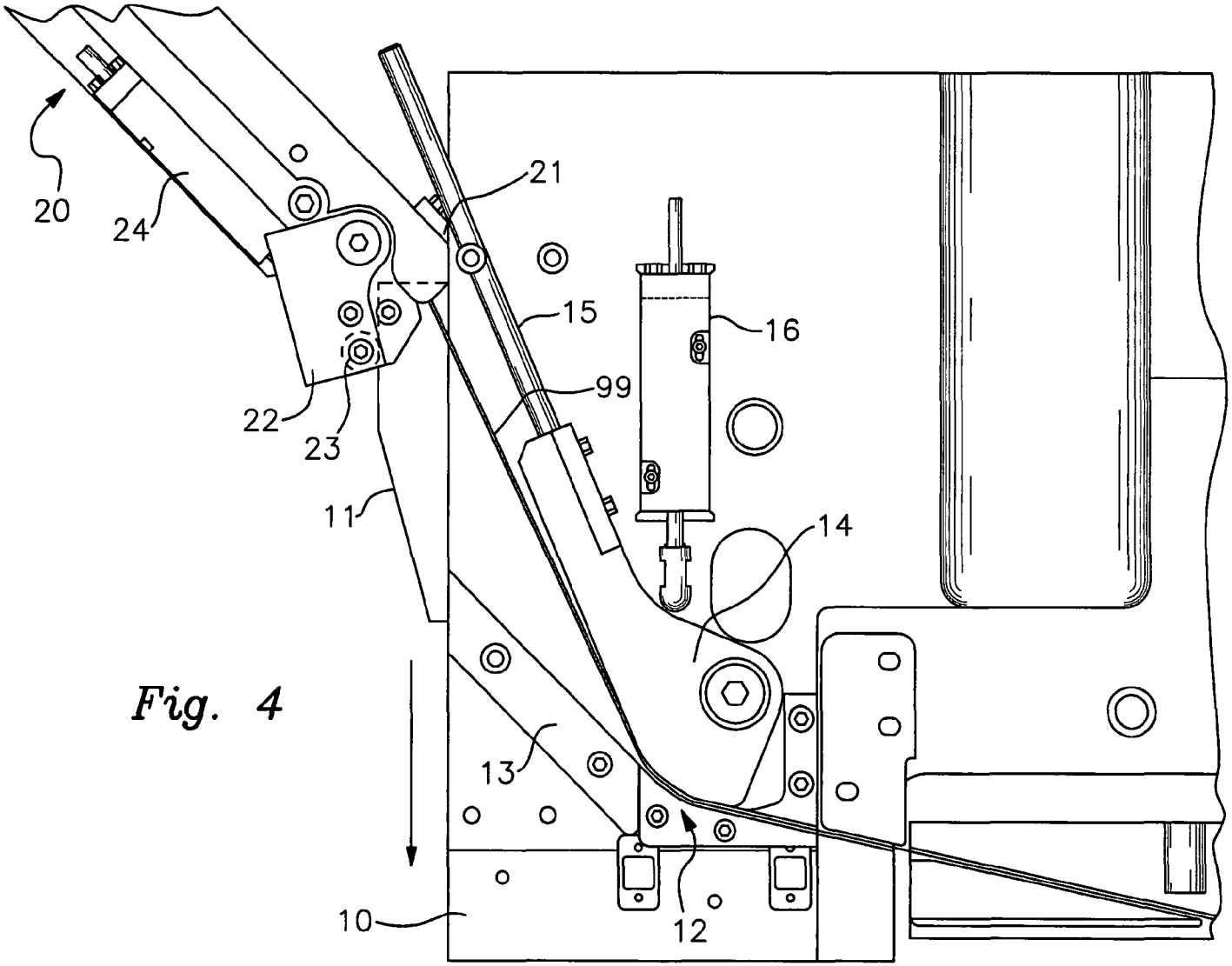
FIG. 4 is a transparent view similar to FIG. 3 of the stationary feed guide assembly and the translating press head assembly, with the press head in the extended or lowered position.
Figure 5:
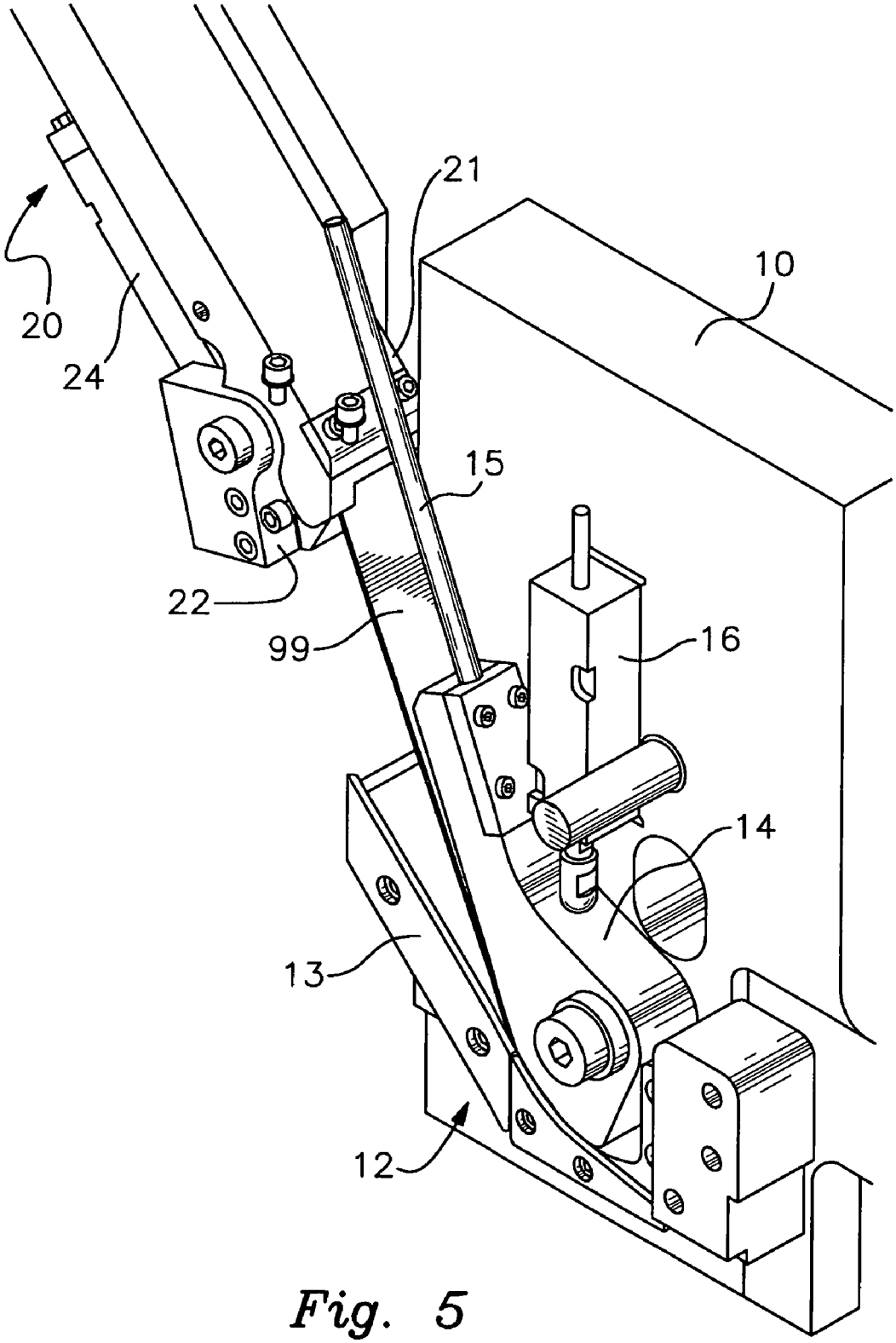
FIG. 5 is a perspective view of the stationary feed guide assembly and the translating press head assembly, with the press head in the extended or lowered position.

As the press head assembly 10 descends into the sealing position, as shown in FIGS. 3, 4 and 5, the lowering wedge cam 11 pushes the cam follower 23 of the feed guide pivoting member 22 outward, such that the feed guide pivoting member 22 pivots away from the band 99. At the same time, the extension member 15 extending from the head guide pivoting member 14 slides on the stationary cam shoulder member 21 to pivot the head guide pivoting member 14 away from the band 99. Thus, as the press head 10 lowers the band 99 has space to extend between the stationary feeding guide assembly 20 and the moving head guide assembly 12 without being drawn or forced onto any edges that might shear the band 99. As the press head assembly 10 retracts the feed guide pivoting member 22 and the head guide pivoting member 14 return to the closed positions to narrow the channels 29 and 30 back to their original dimensions for optimum feeding of the band 99 through the system.

It is contemplated that equivalents and substitutions for certain elements set forth above may be obvious tone of ordinary skill in the art, and therefore the true scope and definition of the invention is to be as set forth in the following claims.

We claim:

1. A bale banding machine comprising a band receiving assembly mounted on a translating overhead press head assembly and a stationary band feeding assembly, said stationary band feeding assembly delivering a band into said band receiving assembly of said overhead press head assembly, said overhead press head assembly reciprocating between a raised retracted position and a lowered sealing position onto a bale to perform a sealing operation;

said stationary band feeding assembly comprising a feed channel receiving said band and a feed guide pivoting member;

said band receiving assembly comprising a head channel receiving said band and a head guide pivoting member;

said machine further comprising means for pivoting said feed guide pivoting member between an open and a closed position, and means for pivoting said head guide pivoting member between an open and a closed position, upon movement of said overhead press head assembly relative to said stationary band feeding assembly;

whereby when said overhead press head assembly moves from said retracted position to said lowered sealing position, said feed guide pivoting member pivots to said open position to widen said feed channel and said head guide pivoting member pivots to said open position to widen said head channel;

and further whereby when said overhead press head assembly moves from said lowered sealing position to said retracted position, said feed guide pivoting member pivots to said closed position to narrow said feed channel and said head guide pivoting member pivots to said closed position to narrow said head channel.

2. The machine of claim 1, wherein said means for pivoting said feed guide pivoting member comprises in combination a cam follower mounted on said feed guide pivoting member and a cam wedge mounted on said overhead press head assembly.

3. The machine of claim 1, wherein said means for pivoting said head guide pivoting member comprises in combination an extension member extending from said head guide pivoting member and a cam shoulder mounted on said stationary band feeding guide assembly.

4. The machine of claim 2, wherein said means for pivoting said head guide pivoting member comprises in combination an extension member extending from said head guide pivoting member and a cam shoulder mounted on said stationary band feeding guide assembly.

5. The machine of claim 1, further comprising means for biasing said feed guide pivoting member and means for biasing said head guide pivoting member, whereby when said overhead press head assembly is in the retracted position, said feed guide pivoting member is maintained in said closed position and said head guide pivoting member is maintained in said closed position.

6. The machine of claim 2, further comprising means for biasing said feed guide pivoting member and means for biasing said head guide pivoting member, whereby when said overhead press head assembly is in the retracted position, said feed guide pivoting member is maintained in said closed position and said head guide pivoting member is maintained in said closed position.

7. The machine of claim 3, further comprising means for biasing said feed guide pivoting member and means for biasing said head guide pivoting member, whereby when said overhead press head assembly is in the retracted position, said feed guide pivoting member is maintained in said closed position and said head guide pivoting member is maintained in said closed position.

8. The machine of claim 4, further comprising means for biasing said feed guide pivoting member and means for biasing said head guide pivoting member, whereby when said overhead press head assembly is in the retracted position, said feed guide pivoting member is maintained in said closed position and said head guide pivoting member is maintained in said closed position.

9. The machine of claim 5, wherein said means for biasing said feed guide pivoting member and said means for biasing said head guide pivoting member comprise spring members.

10. The machine of claim 6, wherein said means for biasing said feed guide pivoting member and said means for biasing said head guide pivoting member comprise spring members.

11. The machine of claim 7, wherein said means for biasing said feed guide pivoting member and said means for biasing said head guide pivoting member comprise spring members.

12. The machine of claim 8, wherein said means for biasing said feed guide pivoting member and said means for biasing said head guide pivoting member comprise spring members.

13. The machine of claim 1, wherein said open position of said feed guide pivoting member is away from and below said band and wherein said open position of said head guide pivoting member is away from and above said band.

14. The machine of claim 4, wherein said open position of said feed guide pivoting member is away from and below said band and wherein said open position of said head guide pivoting member is away from and above said band.

15. The machine of claim 5, wherein said open position of said feed guide pivoting member is away from and below said band and wherein said open position of said head guide pivoting member is away from and above said band.

16. A bale banding machine comprising a band receiving assembly mounted on a translating overhead press head assembly, said stationary band feeding assembly delivering a band into said band receiving assembly of said overhead press head assembly, said overhead press head assembly reciprocating between a raised retracted position to receive said band and a lowered sealing position onto a bale to seal said band about the bale;

said stationary band feeding assembly comprising a feed channel receiving said band and a feed guide pivoting member;

said band receiving assembly comprising a head channel receiving said band and a head guide pivoting member;

said machine further comprising means for pivoting said feed guide pivoting member between an open and a closed position, and means for pivoting said head guide pivoting member between an open and a closed position, upon movement of said overhead press head assembly relative to said stationary band feeding assembly;

wherein said means for pivoting said feed guide pivoting member comprises in combination a cam follower mounted on said feed guide pivoting member and a cam wedge mounted on said overhead press head; and wherein said means for pivoting said head guide pivoting member comprises in combination an extension member extending from said head guide pivoting member and a cam shoulder mounted on said stationary band feeding guide assembly;

whereby when said overhead press head assembly moves from said retracted position to said lowered sealing position, said feed guide pivoting member pivots to said open position to widen said feed channel and said head guide pivoting member pivots to said open position to widen said head channel;

whereby when said overhead press head assembly moves from said lowered sealing position to said retracted position, said feed guide pivoting member pivots to said closed position to narrow said feed channel and said head guide pivoting member pivots to said closed position to narrow said head channel; and said machine further comprising means for biasing said feed guide pivoting member and means for biasing said head guide pivoting member, whereby when said overhead press head assembly is in the retracted position, said feed guide pivoting member is maintained in said closed position and said head guide pivoting member is maintained in said closed position.

17. The machine of claim 16, wherein said means for biasing said feed guide pivoting member and said means for biasing said head guide pivoting member comprise spring members.

18. The machine of claim 16, wherein said open position of said feed guide pivoting member is away from and below said band and wherein said open position of said head guide pivoting member is away from and above said band.

* * * * *